US005618070A

United States Patent [19]

Tunis et al.

[11] Patent Number: 5,618,070

[45] Date of Patent: Apr. 8, 1997

[54] PUSH BUTTON QUAKE LATCH

[76] Inventors: Robert H. Tunis, 366 Alosta Way, Camarillo, Calif. 93010; Randal R. Schanley, 6845 ½ Hazeltine Ave., Van Nuys, Calif. 91405

[21] Appl. No.: 385,789

[22] Filed: Feb. 9, 1995

[51] Int. Cl.[6] ..... E05C 3/14

[52] U.S. Cl. ..... 292/228; 292/DIG. 37

[58] Field of Search ..... 292/137, 198, 292/220, 228, DIG. 37, 231

[56] References Cited

U.S. PATENT DOCUMENTS

| | | | |
|---|---|---|---|
| 1,142,994 | 6/1915 | Telford | 292/86 |
| 1,152,728 | 9/1915 | Hathaway | 292/166 |
| 1,156,632 | 10/1915 | Schoenherr | 292/161 |
| 1,184,084 | 5/1916 | Drzewiecki | 292/198 |
| 3,054,634 | 9/1962 | Westerdale | 292/336.3 |
| 5,375,894 | 12/1994 | Schlack | 292/36 |

FOREIGN PATENT DOCUMENTS

| | | | |
|---|---|---|---|
| 247489 | 2/1990 | Japan | 70/78 |

*Primary Examiner*—Steven N. Meyers
*Assistant Examiner*—Donald J. Lecher
*Attorney, Agent, or Firm*—Michael J. Ram; Marvin H. Kleinberg; Marshall A. Lerner

[57] ABSTRACT

The latch assembly disclosed provides a cabinet latch that is both earthquake and child resistant, but which is easy for an adult to open. This assembly can be used on cabinet doors of differing lengths and configurations.

13 Claims, 4 Drawing Sheets

FIG. 10
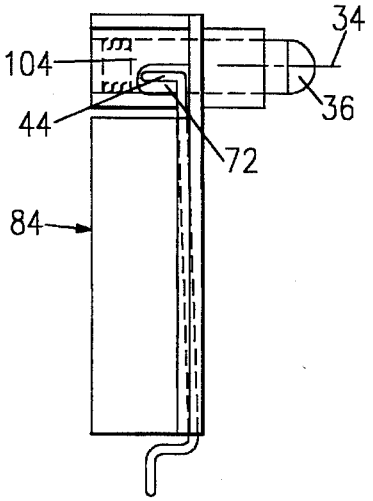
FIG. 11
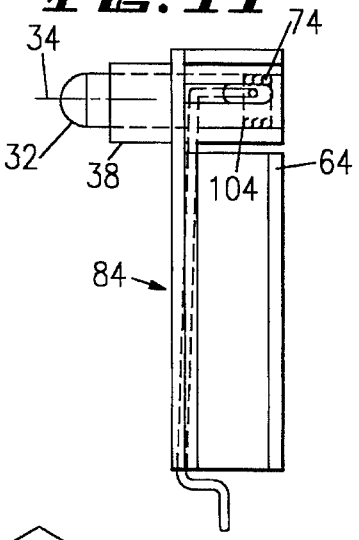
FIG. 12
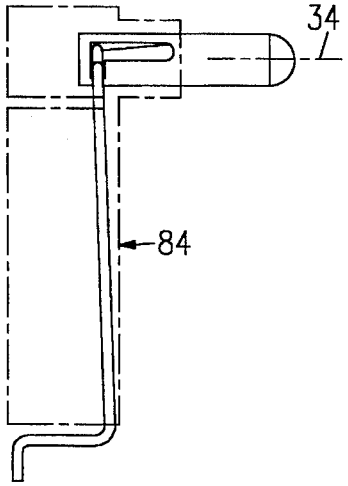
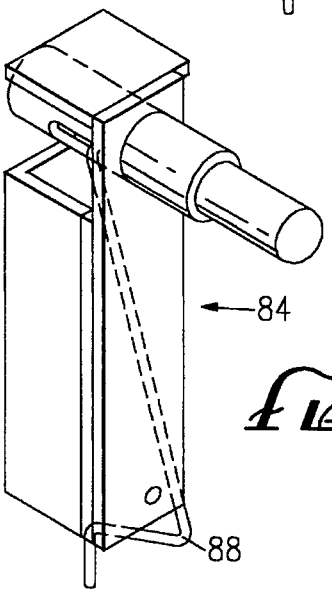
FIG. 13
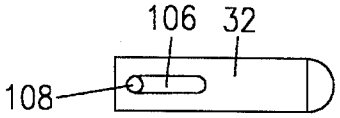
FIG. 14
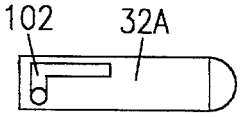
FIG. 16
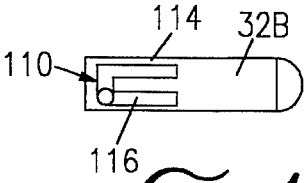
FIG. 18
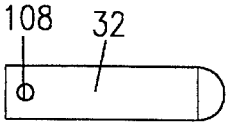
FIG. 15
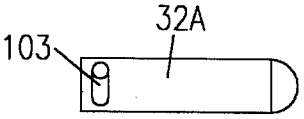
FIG. 17
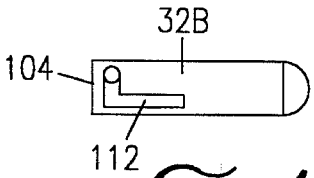
FIG. 19

PUSH BUTTON QUAKE LATCH

This invention relates to a two part latch assembly for mounting within a cabinet. The first part of the assembly is attached to the inside of the cabinet door, and the second part is mounted on the interior of the cabinet so that the two parts of the assembly cooperate to keep the door closed when the cabinet door is shut.

BACKGROUND

Earthquakes in California, Japan, Mexico and elsewhere cause an enormous loss in personal property damage. Much personal property, such as fine china and collectibles, is broken when it is thrown out of its storage cabinet to break upon impact with the floor. Objects falling out of cabinets during an earthquake may act as projectiles and injure people nearby. Keeping cabinet doors closed during earthquakes is therefore desirable to protect both breakable items and people.

Another feature of earthquake resistant latches is that such doors are often child resistant. Typically, infants and toddlers are unable to open doors that require more than a simple tug or pull on the door handle to open the cabinet. Latches that require more than pulling on the handle to open the door therefore can function as child resistant latches.

Several latches designed to keep cabinet doors closed during earthquakes are now marketed. However, all have design features that interfere with ease of use. One such latch currently sold requires either a two-step or two-handed operation. First, the cabinet door is opened slightly with one hand to enable the other hand to be inserted into the cabinet. Then, while the door is held open with the first hand, the second hand disengages the door-mounted latch from the cabinet-mounted striker. Other models of earthquake resistant latches employ a clip mounted on the cabinet door that either clips around or through appropriately shaped strikers mounted within the cabinet. However, cabinet doors held shut using these latches are opened by a firm tug or pull on the cabinet's door knob, and so can be forced open from the inside by the impact of plates or other household objects being flung against the inside of the cabinet door during an earthquake.

SUMMARY OF THE INVENTION

It is an object of the invention to provide a latch assembly that is earthquake resistant yet easy for an adult to open. It is a further object of the invention to provide a latch assembly that can be used on cabinet doors of differing lengths and configurations. It is a still further object of the invention to provide a child resistant lock.

DRAWINGS

These and other features, aspects and advantages of the present invention will become better understood with reference to the following description, appended claims, and accompanying drawings, where:

FIG. 1 is a front perspective view of a first embodiment of an earthquake cabinet latch incorporating features of the invention.

FIG. 1*a* is a bottom view of the first embodiment of the earthquake cabinet latch incorporating features of the invention taken along line 1*a*—1*a* of FIG. 1.

Figure 4A:
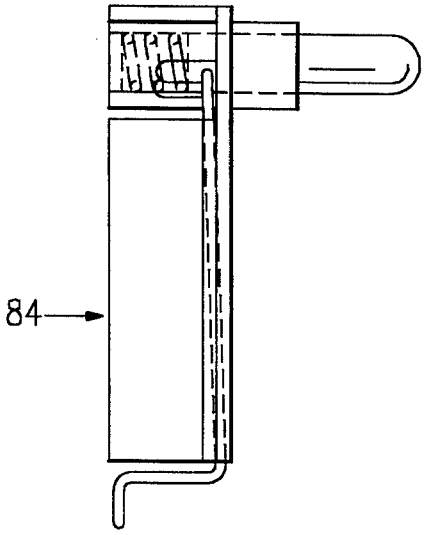
FIG. 4 is a left a side view of the first embodiment shown in FIG. 1.

FIG. 4*a* is a side view of a piston carriage.

Figure 5:
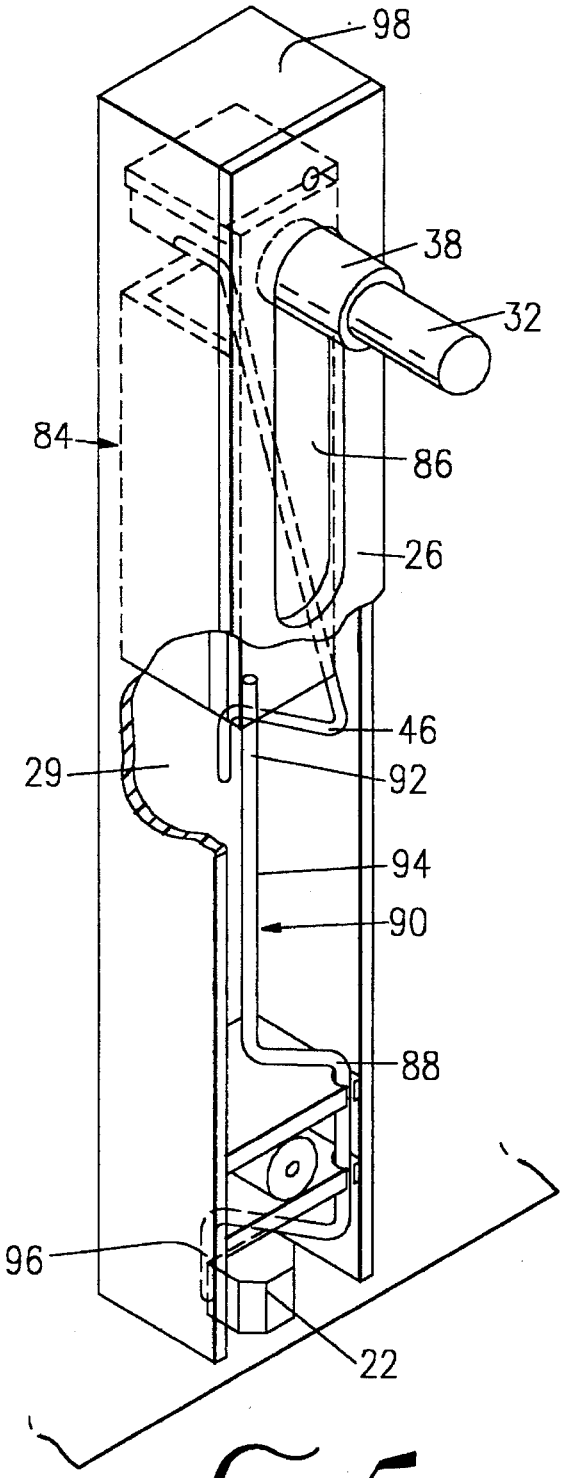

FIG. 5 is a front perspective view of a second embodiment of an earthquake cabinet latch incorporating features of the invention.

Figure 6:
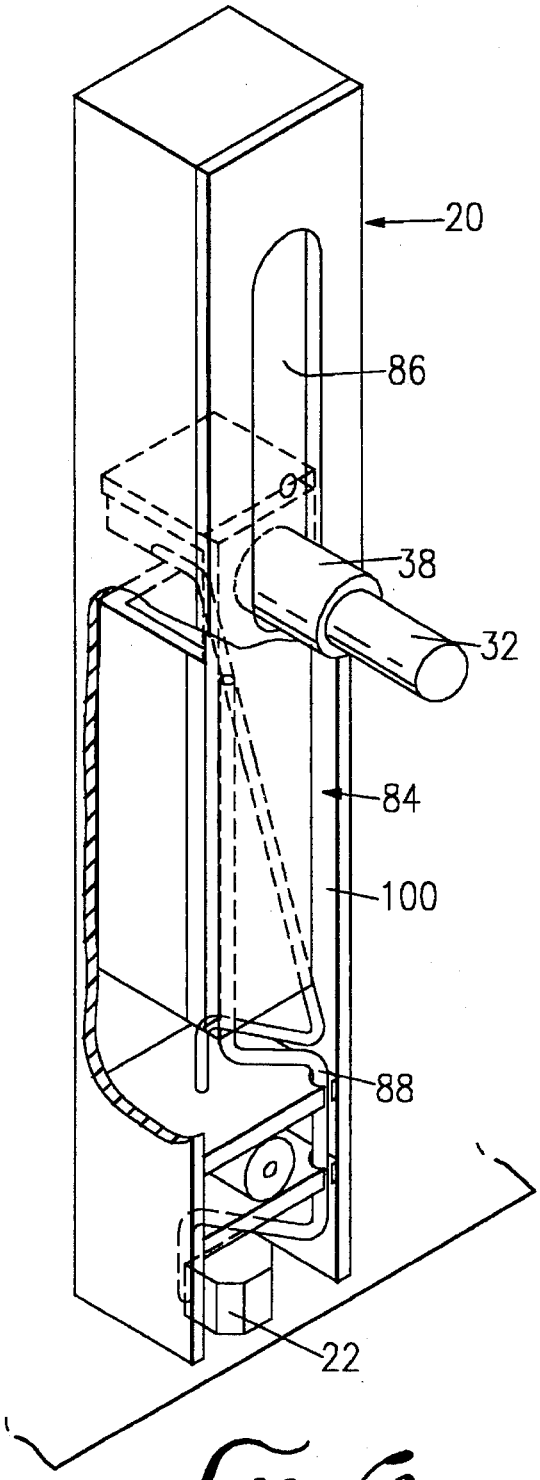

FIG. 6 is a front perspective cutaway view of the second embodiment of FIG. 5 with the piston carriage in a second position.

Figure 7:
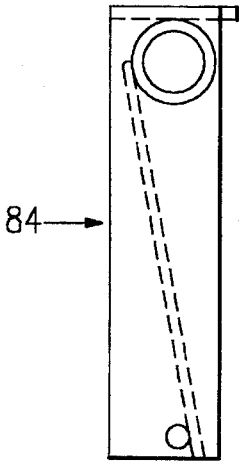

FIG. 7 is a front view of the carrier portion of the carriage assembly of the earthquake cabinet latch of FIG. 5.

Figure 8:
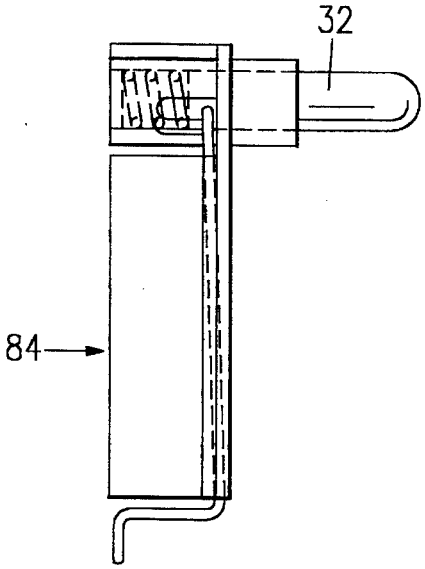

FIG. 8 is a left side view of the piston in the carriage.

Figure 9:
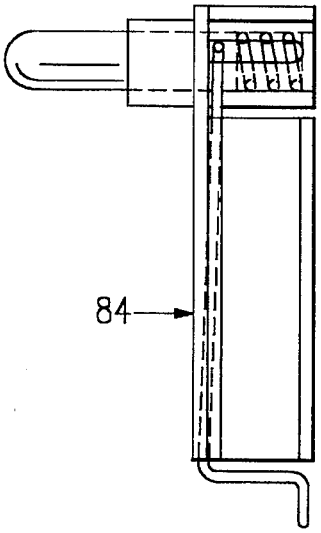

FIG. 9 is a right side view of the piston in the carriage.

FIG. 10 is a left side view of the piston in the carriage as shown in FIG. 8 after activation.

FIG. 11 is a right side view of the piston in the carriage as shown in FIG. 9 after activation.

FIG. 12 is a left side view of a second version of the piston with the piston turned to its locking position.

FIG. 13 is a front perspective view of the piston and carriage assembly of the earthquake cabinet latch of FIG. 5.

Figure 1:
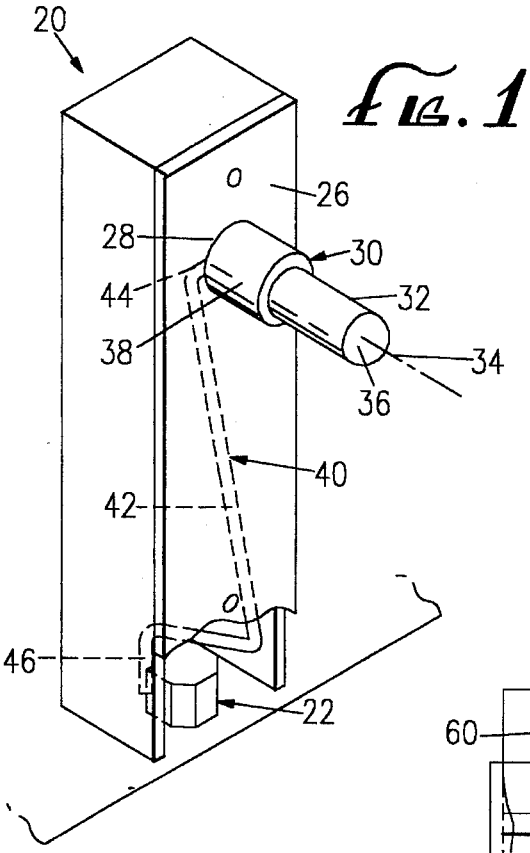

FIG. 14 is a left side view of the first version of the piston of FIG. 1 without a locking feature.

FIG. 15 is a right side view of the first version of the piston of FIG. 1 without a locking feature.

FIG. 16 is a left side view of a second version of the piston of FIG. 12 with a locking feature.

FIG. 17 is a right side view of the second version of the piston of FIG. 12 with a locking feature.

FIG. 18 is a left side view of a third version of the piston of FIG. 13.

FIG. 19 is a right side view of a third version of the piston of FIG. 13.

DETAILED DESCRIPTION

The essential features of the invention, and further optional features, are described in detail in the following passages of the specification which refer to accompanying drawings. The drawings, however, are merely illustrative of how the invention might be put into effect, so that the specific form and arrangement of the features (whether they be essential or optional features) shown is not to be understood as limiting on the invention.

FIG. 1 illustrates the first embodiment of the invention, which is a fixed length model. It comprises the first portion of the assembly 20 being attachable to a surface of a door in the cabinet, and a second portion of the assembly comprising a stackable striker 22 being mountable to the cabinet in an area adjacent to the surface of the door.

The first portion of the assembly 20 itself comprises an elongated hollow enclosure 24 having a first surface 26 adapted to lie against an inner surface of a door. This first surface 26 has an opening 28 extending therethrough. A plunger assembly 30 is mounted in and extends through the opening 28. This plunger assembly 30 comprises a tubular piston 32 having an axis 34 extending along its length, and a first end 36 traverse to said axis 34, and a collar 38.

The collar 38 surrounds at least a portion of the length of the piston 32, said collar 38 being held within the opening in the enclosure 28. The collar 38 is adapted to allow the piston 32 to move within the collar 38 in a direction parallel to the axis of the piston 34.

A control rod 40 comprising a shaft 42 is connected at its first end 44 to the piston 32. The control rod's second end 46 is spaced apart from the first end 44, and this second end 46 is adapted to engage with the striker 22.

Figure 1A:
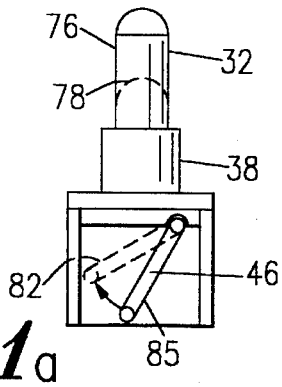

FIG. 1*a* shows the piston 32 in its resting position 76 (solid lines) and in its activated position 78 (dotted lines). FIG. 1*a* also shows the second end of the control rod 46 in its resting position 85 (solid line) and in its activated position 82 (dotted lines). When the piston 32 is displaced from its resting position 76 to its activated position 78, it causes the first end of the control rod 44 to move, which therefore causes the second end of the control rod 46 to pivot in the direction of the arrow from its resting position 85 to its activated position 82.

Figure 2:
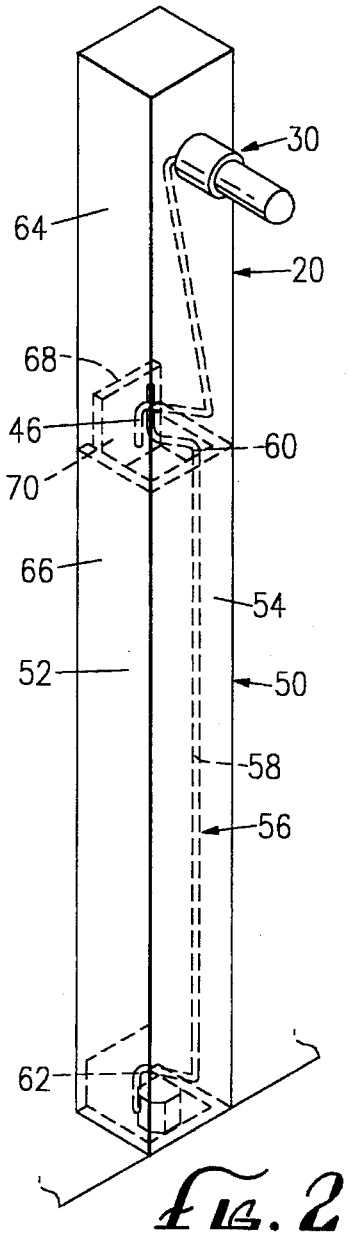
FIG. 2 is a front perspective view of the first embodiment of the earthquake cabinet latch incorporating features of the invention used with an extension.

The first portion of the assembly 20 can also be used in conjunction with an extension 50, and FIG. 2 illustrates the combination of the assembly 20 and the extension 50. The extension 50 comprises an elongated hollow enclosure 52, having a first surface 54 adapted to lie against an inner surface of a door. The extension 50 contains a control rod 56 comprising a shaft 58, a first end 60 and a second end 62 spaced apart from the first end 60.

The extension control rod's first end 60 is adapted to engage with the assembly's control rod's second end 46. Movement of the assembly's control rod's second end 46 is transmitted by way of the extension control rod's first end 60 to the extension control rod's second end 62. The extension control rod's second end 62 is adapted to engage with the stackable striker 22.

The assembly's elongated hollow structure 24 has a second surface 64, and the extension's elongated hollow structure 52 has a second surface 66 that is coplanar with the assembly's second surface 64.

A notch 68 in the assembly elongated structure second surface 64 is adapted to receive a projection 70 of the extension elongated hollow enclosure's second surface 66. This notch 68 and projection 70 fit together to stabilize the relative positions of the assembly 20 and the extension 50 so that the assembly control rod's second end 46 can engage with the extension control rod's first end 60.

Figure 3:
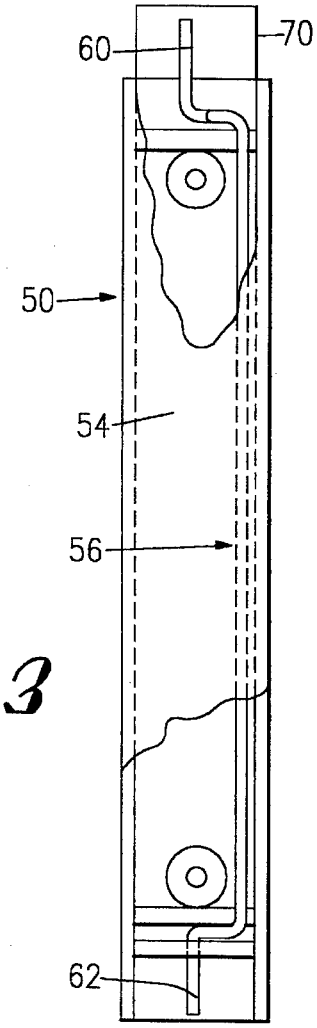
FIG. 3 is a front cutaway view of an extension unit for use with the embodiments of FIGS. 1 or 5.

FIG. 3 illustrates the extension 50 alone, with a partial cutaway of the extension elongated hollow enclosure first surface 54 to reveal the first end of the extension control rod 60 and the second end of the extension control rod 62.

Figure 4:
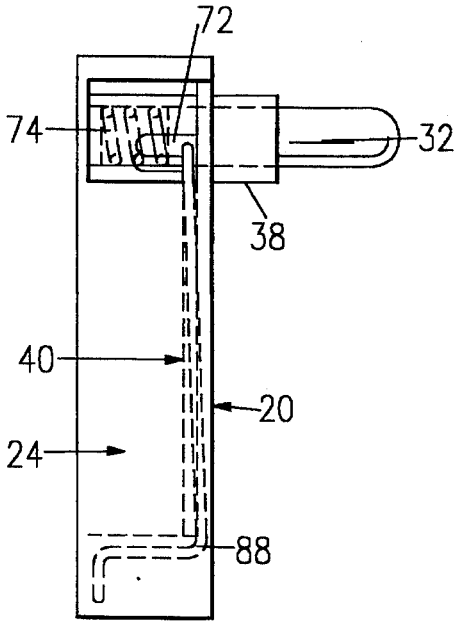

FIG. 4 illustrates the left side view of the piston 32, collar 38, assembly control rod 40 and assembly elongated hollow enclosure 24 of the assembly 20. Also illustrated is an elongated notch 72 in the collar 38 and the piston return spring 74.

The particular structure and method by which the displacement of the piston 32 from its resting position 76 to its activated position 78 causes rotation of the assembly control rod's second end 46 from its resting position 85 to its activated position 82; the manner in which the first end of the assembly control rod 44 articulates with the elongated notch in the collar 72; the use of the piston return spring 74; and the rotation of the second end of the assembly control rod 48; will be set forth in detail below in conjunction with describing a second embodiment of the invention.

FIG. 5 illustrates a cutaway perspective of a second embodiment of the invention. The piston 32, collar 38, assembly control rod 40 and piston return spring 74 are all enclosed in a piston carriage 84, which carriage is illustrated in FIG. 4*a*. The piston carriage 84 is slidably mounted within the assembly elongated hollow enclosure 24. The piston 32and collar 38 extend through an elongated collar opening 86 in the first surface of the assembly elongated hollow enclosure 26.

The second end of the assembly control rod 46 is positioned adjacent to a secondary control rod 90. This secondary control rod 90 has a straight first end 92 that extends from the shaft 94, and a bent end 96 spaced apart from the first end 92. The first end of the secondary control rod 92 is adapted to articulate with the second end of the assembly control rod 40 so that rotational movement of the second end of the assembly control rod 40 moves the first end of the secondary control rod 92. This movement is transmitted to the second end of the secondary control rod 96 by means of the shaft 94.

FIG. 5 illustrates the second embodiment with the piston carriage 84 located at the first end 98 of the elongated collar opening 86. FIG. 6 illustrates the second embodiment of the invention with the piston carriage 84 located at a second end 100 of the elongated collar opening 86. Movement of the piston carriage 84 along the assembly elongated hollow enclosure 24, to the extent that such movement is permitted by the elongated collar opening 86, permits the assembly 20 to be installed in a variety of positions on a cabinet door.

FIGS. 7–11 and 13 illustrate the relationship between the resting positions and activated positions of the piston 32 and control rod Shown in FIGS. 14–19 are three variations,in the piston design 32, 32A, 32B. FIGS. 7–11 also represent the relative resting and activated positions of both piston variations 32A, 32B relative to the control rod 40. The three piston designs 32, 32A, and 32B, can also be used with either the first or the second embodiment of the invention.

FIGS. 7, 8 and 9 illustrate the piston carriage 84 in the front, left and right views, respectively, all with the piston 32 in its resting position. FIGS. 10 and 11 illustrate the piston carriage 84 in the front, left, and right views, respectively. FIG. 12 illustrates the piston 32A in its resting position with the piston 32A locked. FIG. 13 is a perspective view of the piston carriage 84. FIG. 14 is a left side view of the piston 32, while FIG. 15 is a right side view of the piston 32.

As illustrated in FIGS. 7–11 and 13–15 in the first variation in the piston design 32, the first end of the assembly control rod 44 is adapted to fit into the second end of the piston 104. FIG. 14 illustrates the piston 32 with an elongated slot 106 on one side, and a hole that passes through the piston 32 to the other side, where it appears as an exit hole 108 slightly larger than the diameter of the first end of the control rod 44. As the piston 32 is depressed along its longitudinal axis 34, the first end of the control rod 44 rotates within the piston 32 where it is inserted through the elongated slot 106 and out the exit hole 108. This motion is further translated into a rotation of the second end of the control rod 46 as the shaft of the control rod 42 engages with the assembly pivot point 88.

A piston return spring 74 adapted to fit within the collar 38 and between the second surface of the assembly hollow elongated structure 64 and the second end of the piston 104 returns the piston 32 from its activated position to its resting position once pressure on the first end of the piston 36 is released. Similarly, the piston return spring 74 also causes the second end of the assembly control rod 46 to return from its activated position to its resting position when pressure on the first end of the piston 36 is released.

As illustrated in FIGS. 16 and 17, the second variation on the piston design 32A embodies a locking feature. The first end of the assembly control rod 44 is adapted to fit through the elongated notch in the collar 72 into an L-shaped groove 102 proximate to the second end of the piston 104. Opposite this L-shaped groove 102 on the piston 32A is an exit hole 103, orthogonal to the piston's axis of rotation 34, for the first end of the control rod 44. As in the first piston design variation 32, the first end of the control rod 44 rotates within the piston 32A where it is inserted through the L-shaped groove 102 and out the exit hole 103, and the motion is translated into a rotation of the second end of the control rod 46 as the shaft of the control rod 42 engages with the assembly pivot point 88.

However, in this second piston 32A variation, the L-shaped groove 102 provides two positions in which the first end of the control rod 44 may be engaged. When the first end of the control rod 44 is engaged in the horizontal "foot" of the L-shaped groove 102, the piston functions as it did in the first piston design variation 32, and the displacement of the piston 32A along its axis 28 is transmitted to the first end of the control rod 44. However, when the piston 32A with an L-shaped groove 102 is rotated about its own axis 34 so that the first end of the control rod 44 is engaged in the vertical "leg" of the L-shaped groove 102, no movement is transmitted to the first end of the control rod 44. Therefore, the second end of the control rod 46 is not moved from its resting position 80 to its activated position 82, and the assembly 20 cannot be disengaged from the striker 22. This locks the assembly 20 to the striker 22 until the piston 32A is rotated about its axis 34 in a direction opposite its original rotation, which then positions the first end of the control rod 44 in the horizontal "foot" of the L-shaped groove 102, allowing movement of the piston 32A to be transmitted to the control rod 40.

As illustrated in FIGS. 18 and 19, a third variation on the piston design 32B embodies a second locking feature. The first end of the assembly control rod 44 is adapted to fit through the elongated notch in the collar 72 into a U-shaped groove 110 proximate to the second end of the piston 104. Opposite this U-shaped groove 110 on the piston 32B is an L-shaped exit hole 112 for the first end of the control rod 44.

In this third piston 32B variation, the U-shaped groove 110 provides two arms 114, 116 in which the first end of the control rod 44 may be engaged. When the first end of the control rod 44 is engaged in the first arm 114 of the U-shaped groove 110, the first end of the control rod 44 exits through the "foot" of the L-shaped exit hole 112, and the piston 32A function as it did in the first piston 32.

However, when the piston 32B is rotated about its axis 34 so that the first end of the control rod 44 engages in the second arm 116 of the U-shaped groove 110, it exists through the "leg" of the L-shaped exit, hole 112. Therefore, although the piston 32B may be displaced along its vertical axis 34, there is no transmission of its movement to the first end of the control rod 44, and therefore no transmission of movement along its shaft 42 to its second end 46.

What is claimed is:

1. A latch assembly for mounting within a cabinet, a first portion of the assembly being attachable to a surface of a door in the cabinet and a second portion of the assembly being mountable to the cabinet in an area adjacent to the surface of the door, said first portion and second portion cooperating to hold the door in a closed position in relationship to the cabinet, comprising:

a. an elongated hollow enclosure having a first surface adapted to lie against an inner surface of a door, said first surface having an opening extending therethrough, b. a plunger assembly mounted within said opening, the plunger assembly comprising:

i. a tubular piston having an axis extending along its length, a first end transverse to said axis and a second end spaced from the first end, the first end adapted to be manipulated by an operator, the piston adapted to receive a first end of a control rod, ii. a tubular collar surrounding at least a portion of the length of the piston, said collar being held within the opening in the enclosure, the collar being adapted to allow the piston to move within the collar in a direction parallel to the axis of the piston, a hole in the collar adapted to allow passage of a control rod through the hole, iii. a compressible spring positioned within the collar in contact with the piston such that pressure applied to the piston by an operator will cause the spring to become compressed and the piston to be displaced from a resting position and upon removal of the pressure the spring will expand, returning the piston to its resting position, c. a striker for mounting to a cabinet, and d. a control rod comprising a shaft with a predetermined length, the shaft having a first end connected to the plunger through the hole in the collar and a second end adapted to engage with the striker when the door and the piston are in a latching position, the second end of the shaft being removed from contact with the striker when the piston is depressed, the shaft being disposed within the hollow of the enclosure such that when the enclosure is mounted to a cabinet door only the second end of the shaft extends out of the enclosure.

2. The latch assembly of claim 1 wherein the shaft passes through a pivoting point mounted to an interior portion of the enclosure, and depression of the plunger creates a rotational motion in the first end of the shaft, said rotational motion being transferred to the second end of the shaft to create a rotational motion therein, the rotational motion causing the second end of the shaft to disengage from the striker.

3. The latch assembly of claim 1 wherein the piston has an L shaped groove formed therein, the L shaped groove comprised of a foot portion and a leg portion, the leg portion running in the direction of the axis of the piston and the foot portion running transverse to the axis of the piston, the piston adapted to additionally rotate at least partially around its axis and the shaft having a 90° bend in its first end, the first end being adapted for insertion through the hole in the collar and into the L shaped groove such that a rotational force is applied to the shaft only when the piston is moved parallel to its axis and the first end is within the foot portion of the L shaped groove.

4. The latch assembly of claim 3 wherein the piston is rotatable around its axis so that the first end of the shaft is positioned in the leg portion of the L shaped groove and depression of the piston does not transfer a rotational force to the shaft.

5. The latch assembly of claim 1 wherein the piston has a U-shaped groove formed therein, the first and the second arms of the U-shaped groove running in the direction of the axis of the piston, the bottom of the U-shaped groove running transverse to the direction of the axis of the piston; and an L-shaped groove on the opposite side of the piston from the U-shaped groove, the L-shaped groove comprised of a leg portion and a foot portion, the leg portion running in the direction of the axis of the piston and the foot portion running transverse to the axis of the piston; the piston adapted to additionally rotate at lease partially around its axis and the shaft having a 90 degree bend in its first end, such that rotational force is applied to the shaft only when the piston is moved parallel to its axis and the first end is inserted through a hole in the collar and into the first arm of the U-shaped groove and the first end exits out the piston through the leg portion of the L-shaped groove on the opposite side of the piston.

6. The latch assembly of claim 5 wherein the piston is rotatable around its axis so that when the first end of the shaft is positioned in the second arm of the U-shaped groove and exits out the leg of the L-shaped groove, depression of the piston does not transfer a rotational force to the shaft.

7. A latch assembly for mounting within a cabinet, a first portion of the assembly being attachable to a surface of a door in the cabinet and a second portion of the assembly being mountable to the cabinet in an area adjacent to the surface of the door, said first portion and second portion cooperating to hold the door in a closed position in relationship to the cabinet, comprising:

a. an elongated hollow enclosure having a long dimension which is greater in extent than a width which is perpendicular thereto, an axis through the center of the enclosure extending along the long dimension and a first surface adapted to lie against an inner surface of a door, said first surface having an elongated opening extending therethrough, the elongated opening having a long dimension greater in extent than a width which is perpendicular thereto, the long dimension of the enclosure and the long dimension of the opening being cooriented, b. a carriage located within the hollow in the enclosure, c. a plunger assembly mounted to said carriage and within said opening, the plunger assembly comprising:

i. a tubular piston having a axis extending along its length, a first end transverse to said axis and a second end spaced from the first end, the first end adapted to be manipulated by an operator and the piston adapted to receive a first end of a control rod, ii. a tubular collar surrounding at least a portion of the length of the piston said collar being attached to the carriage and held within the opening in the enclosure, the collar being adapted to allow the piston to move within the collar in a direction parallel to the axis of the piston, a hole in the collar adapted to allow passage of a control rod through the hole, iii. a compressible spring positioned within the collar in contact with the piston such that pressure applied to the piston by an operator will cause the spring to become compressed and the piston to be displaced from a resting position and upon removal of the pressure the spring will expand, returning the piston to its resting position, d. a striker for mounting to a cabinet, and e. the control rod comprising a shaft of variable length, the shaft having a first end connected to the piston, a second end adapted to engage with the striker when the door and piston are in a latching position, the second end of the shaft being removed from contact with the striker when the piston is depressed, and means along the length of the shaft to adjust the length thereof, the shaft extending from the carriage and being disposed within the hollow of the enclosure such that when the enclosure is mounted to a cabinet door only the second end extends out of the enclosure.

8. The latch assembly of claim 7 wherein the shaft is formed in at least two pieces composed of an upper piece of a fixed length and a lower piece of a fixed length, the upper piece and the lower piece being operatively connected so that the length of the shaft can be varied, the upper piece being carried in a channel on the carriage and the lower piece of the shaft being held to pivot within the hollow portion of the enclosure such that depression of the piston creates a rotational motion in the upper piece, said rotational motion being transferred to the lower piece to create a rotational motion therein, the rotational motion causing the second end of the shaft to disengage from the striker.

9. The latch assembly of claim 8 wherein the piston has an L shaped groove formed therein, the L shaped groove comprised of a foot portion and a leg portion, the leg portion running in the direction of the axis of the plunger and the foot portion running transverse to the axis of the plunger, the piston adapted to additionally rotate at least partially around its axis and the shaft having a 90° bend in its first end, the first end being adapted for insertion through the collar and into the L shaped groove such that a rotational force is applied to the shaft only when the piston is moved parallel to its axis and the first end is within the foot portion of the L shaped groove.

10. The latch assembly of claim 9 wherein the piston is rotatable around its axis placing the first end of the shaft in the leg portion of the L shaped groove such that depression of the piston does not transfer a rotational force to the shaft and the shaft is not disengaged from the striker.

11. The latch assembly of claim 7 wherein said carriage is movable within the enclosure in the direction of the axis of the enclosure such that when the carriage is moved along the axis of the enclosure the plunger assembly is moved along the long dimension of the opening for placement of the plunger assembly at a desired distance from the striker, the relocation of the plunger assembly not effecting the operation of the latch assembly.

12. The latch assembly of claim 7 wherein the piston has a U-shaped groove formed therein, the first and the second arms of the U-shaped groove running in the direction of the axis of the piston, the bottom of the U-shaped groove running transverse to the direction of the axis of the piston; and an L-shaped groove on the opposite side of the piston from the U-shaped groove, the L-shaped groove comprised of a leg portion and a foot portion, the leg portion running in the direction of the axis of the piston and the foot portion running transverse to the axis of the piston; the piston adapted to additionally rotate at lease partially around its axis and the shaft having a 90 degree bend in its first end, such that rotational force is applied to the shaft only when the piston is moved parallel to its axis and the first end is inserted through a hose in the collar and into the U-shaped groove such that when the first end of the shaft is inserted through the first arm of the U-shaped groove, it exits out the piston through the leg portion of the L-shaped groove on the opposite side of the piston.

13. The latch assembly of claim 12 wherein the piston is rotatable around its axis so that the first end of the shaft is positioned in the second arm of the U-shaped groove and exits out the leg of the L-shaped groove, depression of the piston does not transfer a rotational force tho the shaft.

* * * * *